US007092528B2

(12) United States Patent
Patrick et al.

(10) Patent No.: US 7,092,528 B2
(45) Date of Patent: Aug. 15, 2006

(54) APPARATUS AND METHODS FOR REDUCING NOISE AUDIBLE FROM A SPEAKER

(75) Inventors: Kyle N. Patrick, Maple Ridge (CA); Belwinder B. Barn, Burnaby (CA)

(73) Assignee: International Business Machines Corporation, Armonk, NY (US)

( * ) Notice: Subject to any disclaimer, the term of this patent is extended or adjusted under 35 U.S.C. 154(b) by 890 days.

(21) Appl. No.: 09/993,463

(22) Filed: Nov. 6, 2001

(65) Prior Publication Data

US 2002/0138257 A1 Sep. 26, 2002

(30) Foreign Application Priority Data

Jan. 23, 2001 (CA) ..... 2332140

(51) Int. Cl.
*H04R 29/00* (2006.01)

(52) U.S. Cl. ..... 381/59; 381/58; 381/104; 381/94.5

(58) Field of Classification Search ..... 381/94.5, 381/120, 123, 81, 85, 56, 58
See application file for complete search history.

(56) References Cited

U.S. PATENT DOCUMENTS 5,794,057 A * 8/1998 Lada, Jr. ..... 713/300
5,818,299 A * 10/1998 Tran ..... 330/149
6,281,821 B1 * 8/2001 Rhode et al. ..... 341/144
6,473,663 B1 * 10/2002 Gulick ..... 700/94
6,643,376 B1 * 11/2003 Ackerman et al. ..... 381/56

* cited by examiner

*Primary Examiner*—Brian T. Pendleton
(74) *Attorney, Agent, or Firm*—Karl O. Hesse; Norman L. Gundel

(57) ABSTRACT

A method and apparatus for reducing speaker noise involves producing a control signal indicating whether or not audio program content is imminent in an audio signal operable to be transmitted to a speaker and transmitting the control signal for use by a speaker controller. The speaker controller receives the control signal and the audio signal or a speaker drive signal and provides the speaker drive signal to the speaker in response to the control signal indicating that audio program content is imminent and ceases to provide the speaker drive signal in response to the control signal indicating that audio program content is not imminent.

9 Claims, 5 Drawing Sheets

APPARATUS AND METHODS FOR REDUCING NOISE AUDIBLE FROM A SPEAKER

BACKGROUND OF THE INVENTION

1. Field of Invention

This invention relates to apparatus and methods for reducing noise audible from a speaker and more particularly for reducing such noise when no audio program content is imminent.

2. Background of the Invention

Audio signals in audio devices are typically produced and manipulated at zero decibels above one milliwatt (0dBm) which is a line level signal having a voltage level of about 0.775 Volts. These audio signals are manipulated in audio equipment such as signal processing equipment and are usually ultimately amplified to some greater voltage level at high drive current levels to provide sufficient power to drive a speaker. The power required to drive a speaker is considerably greater than the 0dbm signals manipulated in signal processing equipment and therefore high gain amplifiers are used to amplify audio signals up to speaker drive levels. These high gain amplifiers however, often have a DC bias point at their input, which establishes a common mode voltage enabling an audio signal having positive and negative signal swings to be received at the input. This common mode voltage results in a quiescent current flowing into the amplifier and this current acts as an input signal, which is amplified by the high gain amplifier causing an amplified quiescent current signal to be present in the drive signal provided to the speaker. This amplified quiescent signal appears as loud white noise in some systems.

Attenuating the quiescent current by using low noise amplifier designs is desirable, but still does not sufficiently reduce the audibility of the amplified quiescent signal when high volume levels are sought from the amplifier. This effect is quite noticeable on speaker systems used with personal computers.

What would be desirable therefore is a system which reduces or eliminates the audibility of the amplified quiescent current signal, especially in personal computer systems.

SUMMARY OF THE INVENTION

The present invention addresses the above needs by providing a method and apparatus for reducing speaker noise.

In accordance with one aspect of the invention, there is provided a method of reducing speaker noise including producing a control signal indicating whether or not audio program content is imminent in an audio signal operable to be transmitted to a speaker, and transmitting the control signal, for use by a speaker controller operable to provide a speaker drive signal to the speaker in response to the audio signal and the control signal.

The method may further include receiving an audio status signal indicating a change in audio program content from an audio device and setting the control signal active in response to at least one audio status signal indicating a change from no audio content contribution to an audio content contribution by an audio device. A counter value may be incremented in response to each audio status signal received and the control signal may be rendered active while the counter has a value greater than a predetermined value. The counter value may be decremented in response to the audio status signal and the control signal may be rendered inactive when the counter value is equal to the predetermined value. Setting the control signal may include writing to a register in control of the state of the control signal.

Audio status signals may be received as function calls from programs in a processor system, including an operating system of the processor system. Such function calls may be received at a component of an operating system, and/or may invoke a function of an operating system to cause the control signal to be produced.

In accordance with another aspect of the invention, there is provided an apparatus for reducing speaker noise including a control signal generator for producing a control signal indicating whether or not audio program content is imminent in an audio signal operable to be transmitted to a speaker, and a transmitter for transmitting the control signal for use by a speaker controller operable to provide a speaker drive signal to the speaker, in response to the audio signal and the control signal. The control signal generator may be operable to receive an audio status signal indicating a change in audio program content from an audio device and operable to set the control signal active in response to at least one audio status signal indicating a change from no audio content contribution to an audio content contribution by an audio device. A counter may be incremented in response to the audio status signal such that the control signal is maintained active while the counter has a value greater than the predetermined value. The counter may be decremented in response to the audio status signal and the control signal may be rendered inactive when the counter has a value equal to the predetermined value.

The control signal generator may include a processor circuit operable to run a first block of instruction codes operable to receive an audio status signal from at least one program running on the processor circuit. The first block of instruction codes may include instructions forming part of an operating system of a processor circuit.

In accordance with another aspect of the invention, there is provided a method of reducing speaker noise including receiving a speaker drive signal for use by a speaker, receiving a control signal indicating whether or not audio program content is imminent in the speaker drive signal, and providing the speaker drive signal to the speaker, in response to the control signal indicating audio program content is imminent and ceasing to provide the speaker drive signal in response to the control signal indicating that audio program content is not imminent.

The output of an audio amplifier may be connected or disconnected from the speaker in response to the control signal, thereby providing or ceasing to provide the speaker drive signal to the speaker in response to the control signal.

An audio signal may be amplified to produce the speaker drive signal, and a switch may be activated or deactivated to permit the speaker drive signal to be received at the speaker in response to the control signal indicating audio program content is imminent, or to prevent the speaker drive signal from being received at the speaker.

In accordance with another aspect of the invention, there is provided an apparatus for reducing speaker noise, the apparatus including a first input for receiving a speaker drive signal, a second input for receiving a control signal indicating whether or not audio program content is imminent in the speaker drive signal, and a controller for providing the speaker drive signal to the speaker in response to the control signal indicating that audio program content is imminent and for ceasing to provide the speaker drive signal to the speaker in response to the control signal indicating that audio program content is not imminent.

The controller may include a switch activated by the control signal to connect and disconnect the first input to the speaker, and the switch may include a relay energised in response to the control signal indicating that audio program content is imminent and de-energised in response to the control signal indicating that audio program content is not imminent.

In accordance with another aspect of the invention there is provided a system for reducing speaker noise. The system may comprise an audio signal producing apparatus comprising a control signal generator operable to produce a control signal indicating whether or not audio program content is imminent in an audio signal operable to be transmitted to a speaker, and a transmitter operable to transmit the control signal for use by a speaker controller operable to provide a speaker drive signal to the speaker in response to the audio signal and a control signal. In addition, the system comprises a speaker controller comprising a first input operable to receive a speaker drive signal, a second input operable to receive a control signal indicating whether or not audio program content is imminent in the speaker drive signal and a controller operable to provide the speaker drive signal to the speaker in response to the control signal indicating that audio program content is imminent and for ceasing to provide the speaker drive signal to the speaker in response to the control signal indicating that audio program content is not imminent.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION OF PREFERRED EMBODIMENTS OF THE INVENTION

Figure 1:
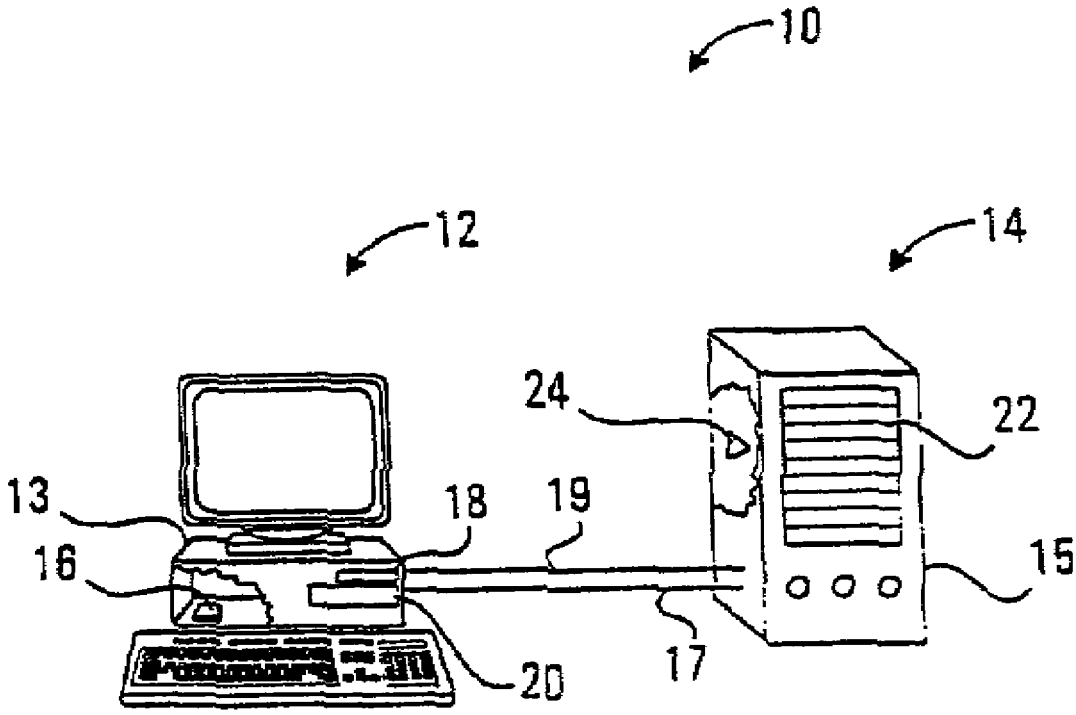
FIG. 1 is a schematic representation of a system for reducing speaker noise according to a first embodiment of the invention.

Referring to FIG. 1, a system for reducing speaker noise, according to a first preferred embodiment of the invention, is shown generally at 10. In this embodiment, the system includes an audio signal producing apparatus 12 and a speaker controller 14 which are shown as a personal computer system 13 and a speaker unit 15 respectively. These apparatus need not be separate, but rather may be housed within the same housing, such as in a laptop computer, for example. Furthermore, the invention may be embodied in other devices, besides computer systems, as will become apparent to the reader below.

Figure 2:
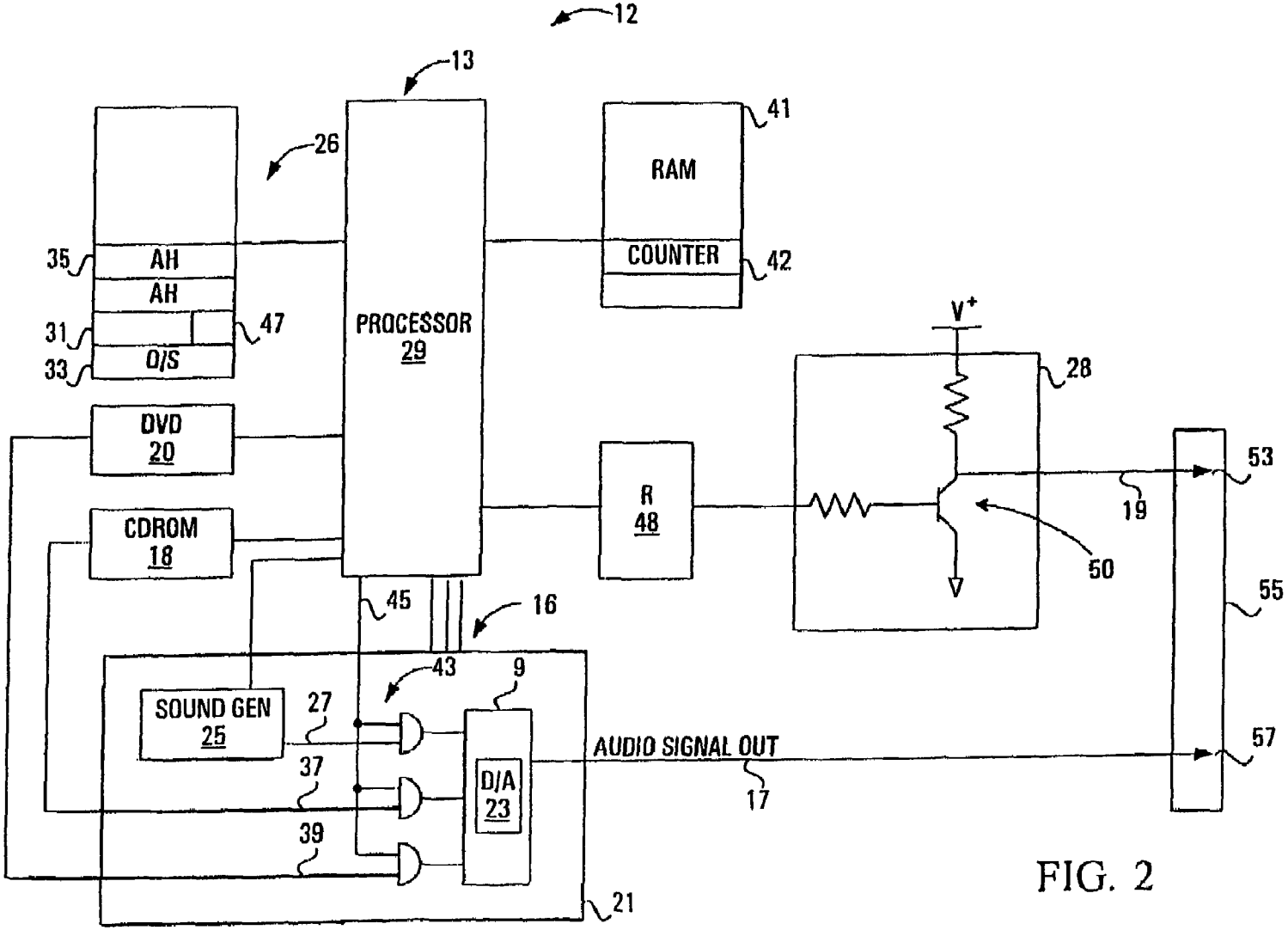
FIG. 2 is a block diagram of an audio signal producing apparatus shown in FIG. 1.

Referring to FIG. 2, the audio signal producing apparatus 12 produces an audio signal at typical line or headphone output voltage levels, for receipt by the speaker controller 14 via an audio signal line 17. In the embodiment shown, this audio signal may be produced by a signal processing circuit 16 under the control of a processor circuit 29 in the personal computer system 13, for example, in response to audio signals originating from audio devices such as a Compact Disc® Read Only Memory (CD-ROM) player 18 or Digital Video Disc® ((DVD) player 20 therein or in communication with the personal computer. Alternatively, the audio signal may be produced by an FM synthesis device, a MDI device, or in response to .WAV files, for example.

In this embodiment, the signal processing circuit 16 is provided on a sound card 21 and includes an audio mixer 9. Each audio device that produces audio content does so in the usual manner, usually by providing digital audio signals to the mixer 9, which mixes the signals from each audio device to produce a single audio output signal. The mixer 9 may include a multiple input D/A converter 23, for example, and be under the control of software run by the processor circuit 29. The CD-ROM player 18 and/or the DVD player 20 may be plugged into the sound card, for example. The sound card 21 may include a sound generator 25 responsive to .WAV or MDI files, for example, to produce a digital audio input signal on signal line 27. This digital audio input signal may be provided along with other digital audio input signals 37 and 39 such as may be produced by the CD-ROM player 18 and the DVD player 20, for example, to an "AND" function, such as may be provided by a plurality of "AND" gates 43. The "AND" function may be controlled by a signal produced by the processor 29 on a signal line 45, to provide a strict zero value at each of the inputs to the D/A converter or to permit the digital audio signals to be received at inputs to the D/A converter 23. The signal produced on the signal line 45 may be a replica of the control signal, the control signal itself, or a derivative of the control signal, for example, to permit the control signal to control the operation of the digital to analog converter and more particularly to control an input thereof. In the example shown, effectively all inputs to the digital to analog converter 23 are controlled by the plurality of AND gates. In this way the inputs to the digital to analog converter 23 may be forced to zero, thereby eliminating noise at inputs to the D/A converter 23 and reducing noise in the analog audio signal it produces.

It will be appreciated that in a multiple channel system, such as a stereo system, there may be two audio output signals. Regardless of how many audio output signals are produced, each audio output signal is provided at a separate output terminal, which may be part of a line output or a headphone output of the personal computer system 13, for example. Referring back to FIG. 1, in this embodiment, the speaker controller 14 receives the audio signal on line 17 and is operable to amplify it to produce a speaker drive signal for driving a speaker 22 which may be housed within the speaker unit or separate. Alternatively, amplification of the audio signal may be performed outside the speaker controller 14 and a speaker drive signal may be provided to the speaker controller 14.

The audio signal producing apparatus 12 also produces a control signal indicating whether or not audio program content is imminent in the audio signal and transmits this control signal on a control signal line 19, for use by the speaker controller 14.

In this embodiment, the speaker controller 14 receives the audio signal and the control signal and produces and provides a speaker drive signal to the speaker 22 when the control signal indicates audio program content is imminent and ceases to provide the speaker drive signal to the speaker when the control signal indicates that audio program content is not imminent. When no speaker drive signal is provided to the speaker, no sound is heard from the speaker, hence no noise is heard.

To achieve the above functionality, referring to FIG. 2, the audio signal producing apparatus 12 includes a control signal generator 26 for producing the control signal to indicate whether or not audio program content is imminent in the audio signal, and further includes a transmitter 28 for transmitting the control signal for use by the speaker controller 14 shown in FIG. 1. In this embodiment, the control signal generator 26 includes the processor circuit 29 of the personal computer system 13 and a first block of instruction codes 31 which in this embodiment is part of an operating system 33, typically provided by a processor readable medium accessible by the processor circuit 29. In this embodiment, the processor readable medium may be a memory device such as a disc drive or CD-ROM, or EPROM, for example, but could alternatively be a communications link operable to communicate with a remote device. The communications link may include the Internet, for example.

The first block of instruction codes 31 directs the processor circuit 29 to generate the control signal in response to audio status signals, or more particularly in this embodiment, in response to function calls made by commands of the operating system 33 invoked by one or more audio handler programs 35 associated with an audio device. An audio handler program 35 may include an audio driver, for example, which controls the operation of the CD ROM player 18 and/or the DVD player 20, or any other audio device, for example, by making function calls to certain commands of the operating system. Examples of such commands in the Microsoft Operating System to which such function calls can be made are listed below:

| | | |
|---|---|---|
| SndPlaySound | WaveOutWrite | WaveOutReset |
| MessageBeep | WaveOutPause | WaveOutReset |
| WaveOutRestart | WaveOutOpen | waveOutClose |
| MciSendString | MciSendCommand | PlaySound |
| MidiOutShortMsg | MidiOutMessage | MidiOutLongMsg |
| MCIWndCreate | MCIWndHome | MCIWndPause |
| MCIWndPlay | MCIWndPlayFrom | MCIWndPlayFromTo |
| MCIWndPlayTo | MCIWndResume | MCIWndSeek |
| MCIWndStop | AVIStreamWrite | AuxOutMessage |

Consequently, to facilitate the operation of the present embodiment, each of the above commands and any others which relate to the control of audio content is modified to make a further function call to the first block of instruction codes 31 before audio program content from an audio device is provided in the audio signal, and after audio program content from an audio device has ended. Thus, for use in this embodiment all operating system audio control commands (such as those listed above and others like them), are pre-configured with routines which produce function calls to the first block of instruction codes 31. More generally these operating system audio control commands may be said to produce audio status signals to indicate when audio program content is about to change.

In this embodiment, an audio status signal produced by any of the above commands, after modification as described above, includes an indication that it is an audio control function call and an argument indicating whether audio content is about to be supplied or whether currently supplied audio content is to be discontinued. Generally, an audio status signal is used to indicate a change in audio program content from the CD-ROM and/or the DVD player or and/any other audio device.

Figure 3:
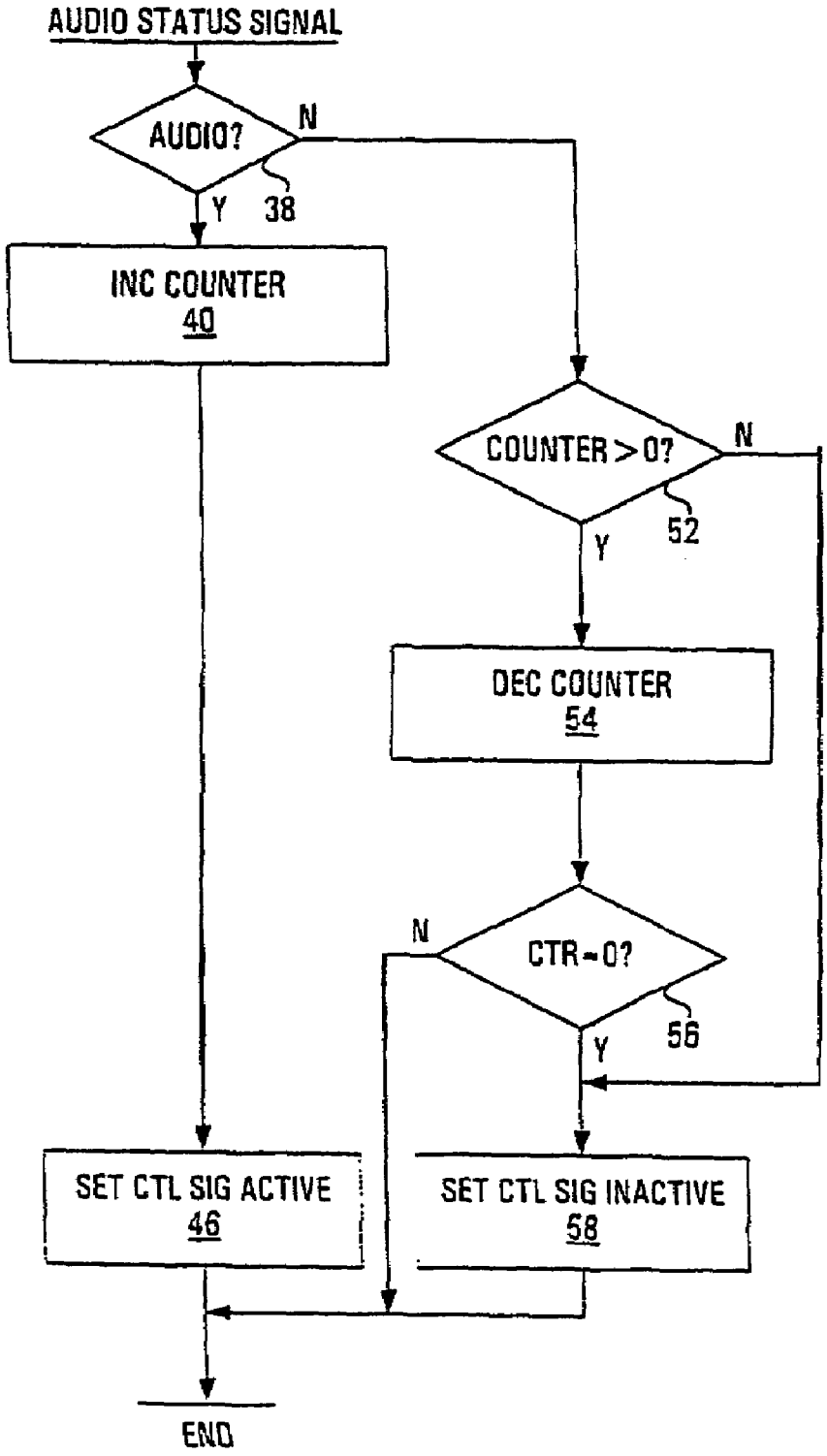
FIG. 3 is a flowchart depicting functionality provided by a first block of instruction codes running on a processor circuit of FIG. 2.

FIG. 3 shows a flowchart 36 depicting a process effected by the first block of instruction codes 31 which cooperates with the processor circuit to function as the control signal generator 26. The process is invoked upon receipt of an audio status signal, which, as stated above, may be a function call to the first block of instruction codes 31, by one of the Microsoft Operating System Commands mentioned above, suitably modified to produce audio status signals as described, or by any other program adapted or designed to produce such a function call.

Referring to FIGS. 2 and 3, a first block 38 directs the processor circuit 29 to examine the argument in the function call to determine whether the function call is an indication that an audio device is about to produce an audio signal or that the audio device will discontinue using the audio services of the personal computer system 13.

If the function call indicates that an audio signal is about to be produced by an audio device, block 40 directs the processor circuit 29 to increment a counter. This is done by causing the processor circuit 29 to increment a value in a counter register 42 in RAM 41 shown in FIG. 2. Thus, in effect, the counter register 42 is incremented in response to an audio status signal indicating a change from no audio content contribution to an audio content contribution by at least one audio device. More generally, whenever an audio device is about to provide audio content, the counter register 42 is incremented, thus, effectively counting the number of audio devices which will be providing audio content.

After the counter register 42 has been incremented, block 46 directs the processor circuit 29 to set the control signal active. This may be done by causing the processor circuit 29 to write to a control register 48 in an output port, as shown in FIG. 2, for example. The contents of the control register 48 may control the state of an output of a driver, such as a transistor 50, for example, which may act as the transmitter 28 for transmitting the control signal to the speaker controller 14 shown in FIG. 1.

Referring back to FIGS. 2 and 3, alternatively, if upon entry into the process at block 38, the argument in the function call indicates that the associated audio device will discontinue providing audio content, block 52 directs the processor circuit 29 to determine whether the counter value is greater than zero. If so, block 54 directs the processor circuit 29 to decrement the counter value by decrementing the contents of the counter register 42. Thus the counter register 42 is decremented in response to an audio status signal indicating a change from audio content contribution to no audio content contribution by an audio device.

Block 56 then directs the processor circuit 29 to determine whether the counter value is equal to zero. If the counter value is not equal to zero, the process is ended. If the counter value is zero, or if at block 52 the counter value was not greater than zero, block 58 directs the processor circuit 32 to set the control signal inactive, by writing to the control register 48. Thus the contents of the counter register 42 cause the control signal to be rendered inactive when the counter register 42 has a value equal to the predetermined value. From the foregoing it will be appreciated that each time an audio device indicates that audio content is forthcoming or imminent, the counter value is incremented and each time a device previously providing audio content indicates that no further audio content is imminent the counter value is decremented. Thus, the counter value is indicative of the number of audio devices which are or will be contributing audio content to the audio signal.

In effect, the control signal generator 26 is operable to set the control signal active in response to at least one audio status signal indicating a change from no audio content contribution to an audio content contribution by an audio device and is operable to set the control signal inactive in response to determining that no audio content is expected to be imminently provided by any audio device.

Figure 4:
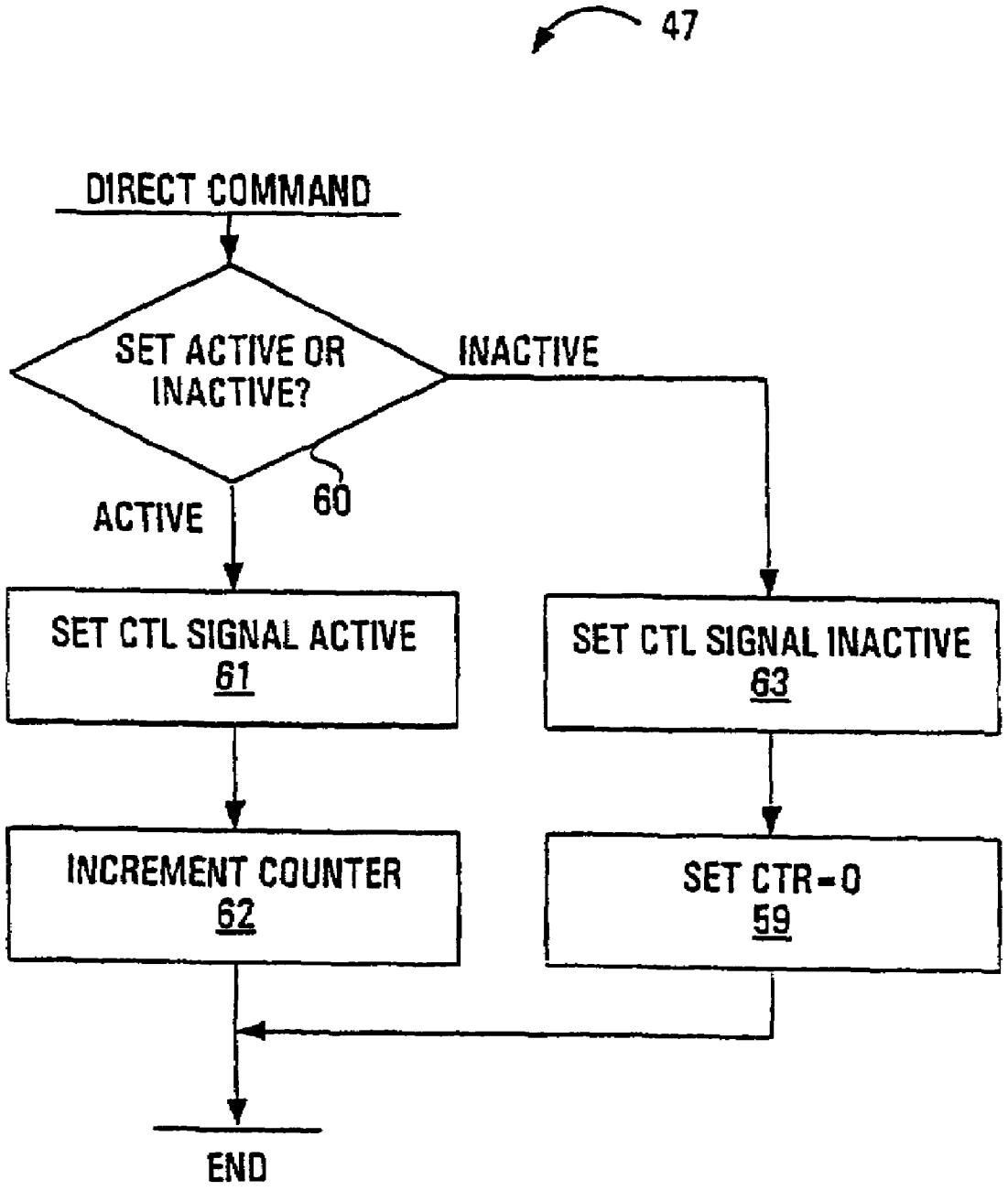
FIG. 4 is a flowchart of a second block of instruction codes running on the processor circuit of FIG. 2.

Referring to FIGS. 2 and 4, a second block of codes 47 in the operating system 33 may direct the processor circuit 29 to respond to a different type of audio status signal which directly indicates that the control signal should be set active or inactive. Certain commands of the Microsoft operating system may be configured to issue audio status signals of this type, for example, or any other program running on the processor circuit may be adapted or designed to produce such audio status signals. Commands which may issue this type of audio status signal may be invoked by processes associated with shut down of the computer system, for example. This can be used to prevent any transient noise induced on the audio signal line during system shutdown from being amplified by the amplifier 24 and heard as noise at the speaker 22.

Other processes which may desirably cause the control signal to be directly set active or inactive may include control processes associated with a user login command, for example. Such processes may permit the user to directly control the control signal causing it to be set active or inactive by the user for example.

A flowchart depicting the process executed by this second block of codes is shown generally at 47 in FIG. 4. Referring to FIGS. 2 and 4, the process shown in FIG. 4 begins with a first block 60 which determines whether the received command is intended to set the control signal active or inactive. If the command is to set the control signal active, block 61 directs the processor to directly write to the control register 48 to set the control signal active regardless of the counter value. Block 62 then directs the processor to increment the contents of the counter register 42. The process is then ended. If at block 60 the received command is intended to set the control signal inactive the processor 29 is directed to block 63 which causes the processor to set the control signal inactive by directly writing to the control register 48 to set the control signal inactive, regardless of the counter value. Block 59 then directs the processor 29 to write to the counter register 42 to set the counter value equal to zero. The process is then ended. Thus, it may be seen that direct control over the control signal is provided.

In this embodiment, only one control signal is produced, regardless of the number of audio signals produced. Alternatively separate control signals may be produced for each audio signal, such as Left and Right audio signals, if desired.

The control signal may be provided at a terminal 53 on a connector 55 separate from a connector acting as the line output or headphone output, or as shown in this embodiment may be provided at a separate terminal 57 on the same connector 55. Alternatively, the control signal may be multiplexed onto the audio signal as a DC component, for example.

Referring to FIG. 1, in this embodiment signal lines 17 and 19 are used to carry, or more generally transmit, the control signal and the audio signal to the speaker controller 14. Alternatively, non-contact means may be used to transmit the control signal and/or the audio signal to the speaker controller 14. Non-contact means may include infrared, RF or optical signaling systems, for example.

Figure 5:
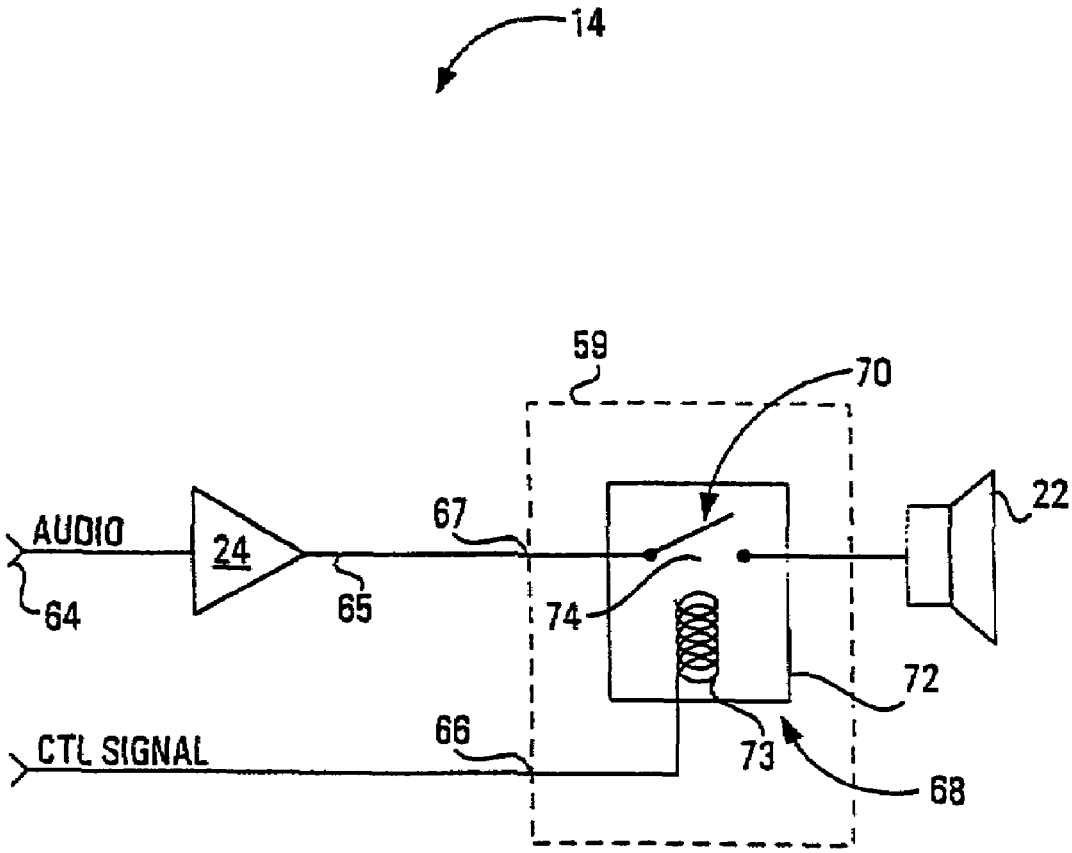
FIG. 5 is a schematic diagram of a speaker controller shown in FIG. 1.

Referring to FIG. 5, in this embodiment, the speaker controller 14 includes a first input 64 for receiving the audio signal and has an amplifier 24 having an output 65 for producing a speaker drive signal at sufficient voltage and current levels to cause the speaker 22 to produce audible sound within its operating range of sound power. The speaker controller 14 further includes an apparatus shown generally at 59 for reducing speaker noise including a speaker drive signal input 67 for receiving the speaker drive signal from the amplifier 24. The apparatus further has a second input 66 for receiving the control signal and further has a controller shown generally at 68 for providing the speaker drive signal to the speaker 22 in response to the control signal indicating that audio program content is imminent and for ceasing to provide the speaker drive signal to the speaker in response to the control signal indicating that audio program content is not imminent.

It will be appreciated that the amplifier 24 need not be contained within the speaker controller 14 and that it may be located remotely, such as in the personal computer 13 shown in FIG. 1, or it may be an external device, for example.

In this embodiment, the controller 68 includes a switch shown generally at 70 activated by the control signal to connect and disconnect the output 65 of the amplifier 24 to and from the speaker 22. In this embodiment, the switch 70 includes a relay 72, having a coil 73 controlled by the control signal and having single pole single throw contacts shown generally at 74 which are connected together when the coil 73 is energized and which are not connected when the coil 73 is not energized. The coil 73 is energized in response to an active control signal indicating that audio program content is imminent and is de-energized in response to an inactive control signal indicating that audio program content is not imminent. Thus, when no audio device intends to provide audio program content, the coil 73 is not energized and the speaker drive signal is prevented from reaching the speaker 22. Consequently, in this condition no sound of quiescent current in the amplifier 24 is heard at the speaker 22. When an audio device indicates that audio program content is imminent as described above, the coil 73 is energized in response to the active control signal and the speaker drive signal is provided to the speaker 22.

Effectively, the speaker drive signal is provided to the speaker 22 when audio program content is imminent or in progress and is not provided to the speaker when no audio program content is in progress or imminent from any audio device, resulting in no audible noise when audio program content is not imminent. Thus, noise audible from the speaker 22 is reduced.

While specific embodiments of the invention have been described and illustrated, such embodiments should be considered illustrative of the invention only and not as limiting the invention as construed in accordance with the accompanying claims.

What is claimed is:

1. A method of reducing noise audible from a speaker, the method comprising:

receiving an audio status signal indicating a change in audio program content from an audio device that audio program content is imminent in an audio signal from said audio device;

producing a control signal from said audio status signal indicating that audio program content is imminent in an audio signal from said audio device, said producing comprising incrementing a counter value in response to said audio status signal indicating that audio program content is imminent in an audio signal from said audio device;

maintaining said control signal active while said counter value is greater than a predetermined value; and, transmitting said control signal, for use by a speaker controller operable to provide a speaker drive signal to said speaker in response to said audio signal and said control signal indicating that audio program content is imminent in an audio signal from said audio device.

2. The method of claim 1 wherein producing comprises decrementing said counter value in response to said an audio status signal indicating that audio program content is not included in an audio signal from an audio device.

3. The method of claim 2 wherein producing comprises setting said control signal inactive when said counter value is equal to said predetermined value.

4. The method of claim 3 wherein selling comprises writing to a register in control of the state of said control signal.

5. An apparatus for reducing speaker noise, the apparatus comprising:

a computer including a processor and memory;

an operating system in the memory for creating commands for controlling operation of audio devices connected to the computer;

a control signal generator for producing a control signal, the control signal generator comprising a counter having a counter value which is incremented in response to at least one of the commands indicating a change from no audio content contribution to an audio content contribution by an audio device; and, a speaker controller connected to a speaker, to the computer and to an audio device, the speaker controller being responsive to the control signal for providing a speaker drive signal to the speaker when audio program content is imminent in the audio signal from the audio device.

6. The apparatus of claim 5 wherein the control signal generator is operable to maintain the control signal active while the counter value is greater than a predetermined value.

7. The apparatus of claim 6 wherein the counter value is decremented in response to at least one of the commands indicating that audio program content is not included in an audio signal from an audio device.

8. The apparatus of claim 7 wherein the counter causes the control signal to be inactive when the counter value is equal to the predetermined value.

9. The apparatus of claim 8 further comprising a register in communication with the counter, for controlling the state of the control signal.

* * * * *

UNITED STATES PATENT AND TRADEMARK OFFICE

CERTIFICATE OF CORRECTION

PATENT NO. : 7,092,528 B2
APPLICATION NO. : 09/993463
DATED : August 15, 2006
INVENTOR(S) : Kyle N. Patrick and Belwinder B. Barn It is certified that error appears in the above-identified patent and that said Letters Patent is hereby corrected as shown below:

Claim 2, column 9, line 12, delete “said” (second occurrence)

Claim 4, column 9, line 18, change “selling” to “setting”

Signed and Sealed this

Fourteenth Day of November, 2006

JON W. DUDAS
*Director of the United States Patent and Trademark Office*